US006233854B1

(12) United States Patent
Levy et al.

(10) Patent No.: US 6,233,854 B1
(45) Date of Patent: May 22, 2001

(54) IRONING BOARD COVER

(75) Inventors: Richard David Levy; Deborah Parrott Brown, both of Greensboro, NC (US)

(73) Assignee: Helmac Products Corporation, Flint, MI (US)

( * ) Notice: Subject to any disclaimer, the term of this patent is extended or adjusted under 35 U.S.C. 154(b) by 0 days.

(21) Appl. No.: 09/325,676

(22) Filed: Jun. 3, 1999

(51) Int. Cl.[7] ..... D06F 83/00
(52) U.S. Cl. ..... 38/140
(58) Field of Search ..... 38/66, 140

(56) References Cited

U.S. PATENT DOCUMENTS

| | | | | |
|---|---|---|---|---|
| 457,033 | | 8/1891 | Sanders . | |
| 1,485,824 | * | 3/1924 | Bass | 38/140 X |
| 1,881,977 | * | 10/1932 | Sundby | 38/140 |
| 2,026,961 | | 1/1936 | Brodt | 68/10 |
| 2,031,595 | * | 2/1936 | Finck | 38/140 |
| 2,264,644 | | 12/1941 | Santangelo | 38/140 |
| 2,269,804 | | 1/1942 | Allaback | 38/140 |
| 2,418,969 | | 4/1947 | Di Gesare | 38/140 |
| 2,811,795 | | 11/1957 | Ashley | 38/140 |
| 2,814,135 | * | 11/1957 | Freeman | 38/140 X |
| 2,850,817 | | 9/1958 | Rudd et al. | 38/140 |
| 2,871,590 | * | 2/1959 | Delander | 38/140 |
| 2,873,544 | * | 2/1959 | Boman | 38/140 |
| 3,007,267 | | 11/1961 | Goldsmith | 38/140 |
| 3,562,934 | | 2/1971 | Cogar | 38/140 |
| 3,733,724 | | 5/1973 | Davis | 38/140 |
| 3,911,603 | | 10/1975 | Lehrman | 38/140 |
| 4,453,292 | | 6/1984 | Bakker | 24/115 |
| 4,557,062 | | 12/1985 | Mattesky | 38/140 |
| 4,621,003 | | 11/1986 | O'Kane | 428/71 |
| 4,675,948 | | 6/1987 | Bengtsson | 24/115 |
| 4,813,166 | | 3/1989 | Drake | 38/140 |
| 4,982,516 | * | 1/1991 | Cervantes | 38/140 |
| 5,231,777 | | 8/1993 | Mattesky et al. | 38/140 |
| 5,392,543 | | 2/1995 | Lehrman | 38/140 |
| 5,497,570 | | 3/1996 | Burshaw et al. | 38/140 |

FOREIGN PATENT DOCUMENTS

| | | | |
|---|---|---|---|
| 2127625 | 9/1996 | (CA) | D06F/83/000 |
| 1173464 | 12/1969 | (GB) | D06F/83/00 |
| 8200942 | 10/1983 | (NL) | D06F/83/00 |

* cited by examiner

*Primary Examiner*—Ismael Izaguirre
(74) *Attorney, Agent, or Firm*—Rhodes & Mason, P.L.L.C.

(57) ABSTRACT

The present invention is a cover for an ironing board that includes a top sheet, a pad of substantially the same size as the top sheet attached to the bottom surface of the top sheet, and a skirt attached about the periphery of the top sheet. The skirt has at least one nose portion, at least two side portions extending rearwardly from the nose portion, and at least one heel portion extending rearwardly from the respective side portions. The skirt also has an adjustable draw cord housed within a hem formed within the skirt. Preferably, the draw cord exits adjacent the heel portion. The cover of the present invention also has at least one cinch that has a first and a second element. Each element has two ends. The respective first ends of the first element and second element are each attached to corresponding and opposing inner edges of the two side portions of the skirt. The second end of the second element is formed with a ring and the second end of the first element is formed with a hook and loop fastener that is threadedly engageable with the ring of the second element. The cinch is adjustably tightenable through the engagement of the hook and loop fastener to tighten the cover upon the ironing board.

7 Claims, 3 Drawing Sheets

IRONING BOARD COVER

FIELD OF THE INVENTION

This invention relates generally to a cover for an ironing board and more particularly to a cover for an ironing board that is designed to fit snugly upon an ironing board thereby easing installation and improving usage of the ironing board.

BACKGROUND OF THE INVENTION

An ironing board is shaped to create an appropriate surface upon which to press clothing and other similar items. It is preferred to cover ironing boards with a cover that is padded to ease pressure and also formed of an appropriate material to allow the iron to glide across the surface. Unfortunately, the shape of an ironing board is an awkward shape to cover. Although the technology exists to create better material to cover the ironing board, there still exists a need for a better cover design to optimize the fit and accord of the ironing board shape.

Several ironing board cover designs attempt to remedy the above-stated problems related to the shape of an ironing board and provide a better fitting cover. For example, U.S. Pat. No. 4,557,062 uses a drawstring to secure the cover to the ironing board after installation. Another prior art approach disclosed in U.S. Pat. No. 5,497,570 uses pleats to alleviate the form-fitting problems. The pleat creates slack in the cover to facilitate the installation of the cover. Also, some prior art covers have used elastic to tighten the cover about the underside of the ironing board. Thus, a larger amount of fabric may be used to fit over the ironing board and then gathered up after the cover is installed. Some covers include standard alligators clips attached with elastic to further tighten the cover at prescribed points. As shown by the prior art, the problem is centered about designing an ironing board cover that is easily installed but thereafter adjustable to fit tightly and snugly about the surface of the ironing board. An important consideration, however, in creating a tightly fitting ironing board cover is the need to make the cover cost-effective for retail sales. Many of the previous methods for tightening the cover to the ironing board use expensive components or larger amounts of material than are necessary. Although the cover may fit snugly, the resulting cost to the consumer is elevated.

There is a need therefore for an ironing board cover that is designed to ease installation, be adjustable to fit snugly about the ironing board, and also be cost-effective to manufacture and sell.

SUMMARY OF THE INVENTION

The present invention is an ironing board cover that includes a top sheet, a pad of substantially the same size as the top sheet attached to the bottom surface of the top sheet, and a skirt attached about the periphery of the top sheet. The skirt is formed of at least one nose portion, at least two side portions extending rearwardly from the nose portion, and at least one heel portion attached to the side portions. Each of the nose portion, side portions, and heel portion includes a hem along the free edge thereof. An adjustable draw cord is housed within the hem. Preferably, the draw cord exits in the hem of the heel portion. The cover of the present invention also has at least one cinch that has a first and a second element. Each element has two ends. The respective first ends of the first element and second element are each attached to corresponding and opposing inner edges of the two side portions of the skirt. The second end of the second element is formed with a ring and the second end of the first element is formed with a hook and loop fastener formed of a hook section and a loop section that is threadedly engageable with the ring of the second element. The cinch may be thereby adjustably tightened by means of the hook and loop fastener to tighten the cover upon the ironing board.

These and other aspects of the present invention as disclosed herein will become apparent to those skilled in the art after a reading of the following description of the preferred embodiments when considered with the drawings. The drawings are for the purpose of describing a preferred embodiment of the invention and are not intended to limit the present invention.

DESCRIPTION OF THE PREFERRED EMBODIMENT

Figure 1:
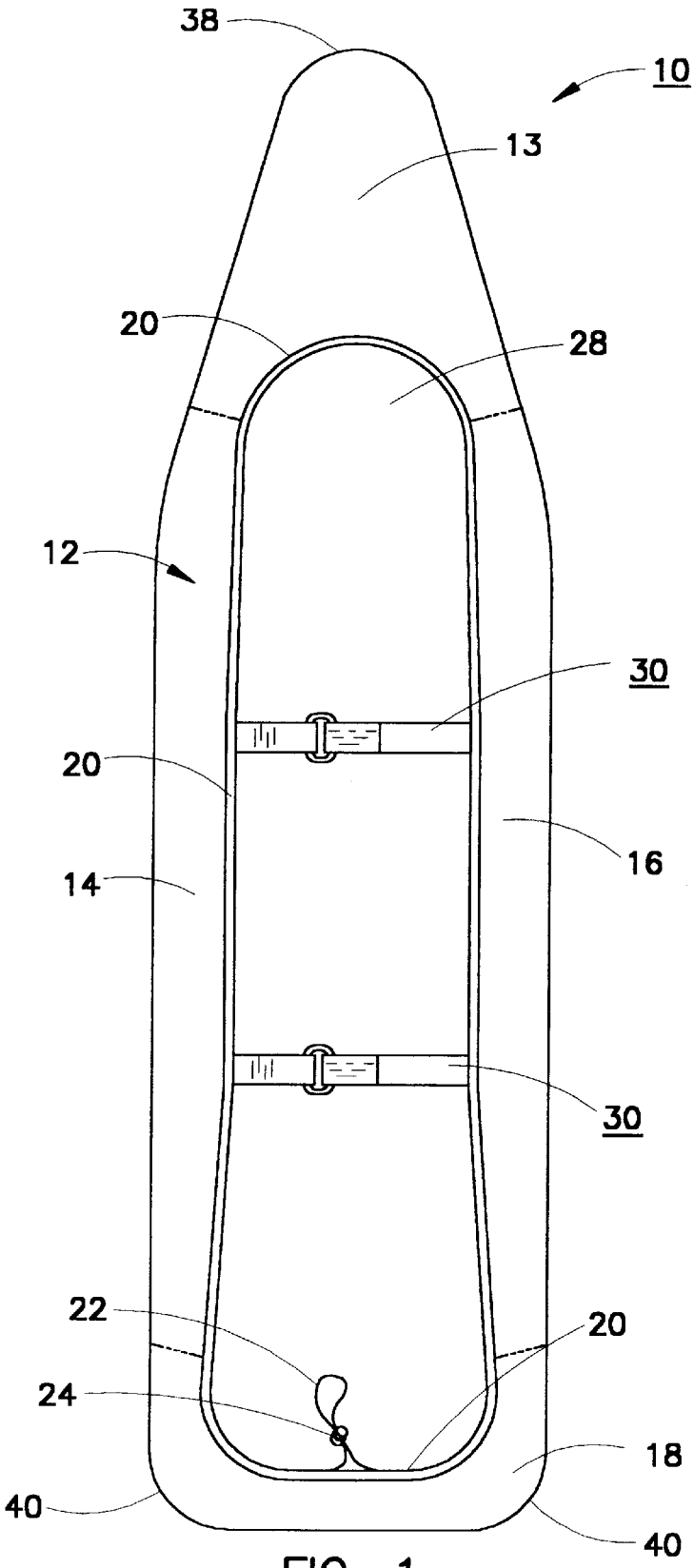
FIG. 1 is a bottom view of one embodiment of the ironing board cover of the present invention.

Referring to FIG. 1, there is illustrated a preferred embodiment of the ironing board cover 10 of the present invention.

Cover 10 preferably is formed from several components to ensure an improved fit upon an ironing board. In addition to a top sheet 26 and a pad 28, the ironing board cover 10 includes a skirt 12. The skirt 12 is formed of four separate portions, namely, a nose portion 13, two opposing side portions 14, 16, and heel portion 18 sewed to the top sheet 26 and together, as illustrated in FIG. 1, to ensure the best fit without wasting materials. The components of skirt 12, namely nose portion 13, side portions 14, 16, and heel portion 18 are appropriately connected to one another, such as by sewing, to form a unitary skirt 12. As shown in FIG. 1, the nose portion 13 may be shaped with a forward arcuate edge 38 and the heel portion 18 may be formed with rearward curved corners 40. The skirt 12 is attached at its outer periphery about the outer periphery of the top sheet 26 through any appropriate means such as sewing or gluing. Preferably, the top sheet 26 is formed with a forward arcuate edge to correspond with arcuate edge 38 of the nose portion 13, a rearward edge having curved corners corresponding to the rearward curved corners 40 of the heel portion 18, and two opposing side edges mesial between the forward and rear edges.

Each portion of the skirt preferably is formed with a draw cord terminal hem 20 along the free edge. When sewed together as described above, the inner periphery of the entire skirt will include a hem 20 for a draw cord 22. In other words, each skirt component, nose portion 13, side portions 14, 16, and heel portion 18 preferably has a hem 20 through which a draw cord 22 extends. The hem 20 preferably is formed about the inner periphery of the skirt distal to the periphery of the top sheet 26. Preferably, draw cord 22 exits from the hem 20 through an opening 21 in the hem of the heel portion 18 of the skirt 12 for improved tightening of the skirt 12 about the bottom of the ironing board by drawing or tightening the draw cord. Although various methods for tightening draw cord 22 are contemplated, the preferred method for restraining the draw cord 22 in a tightly binded condition is through the use of a spring-action-locking device 24, as is known in the art. The preferred draw cord 22 is heavy cord, such as ⅛-inch diameter cord.

Figure 2:
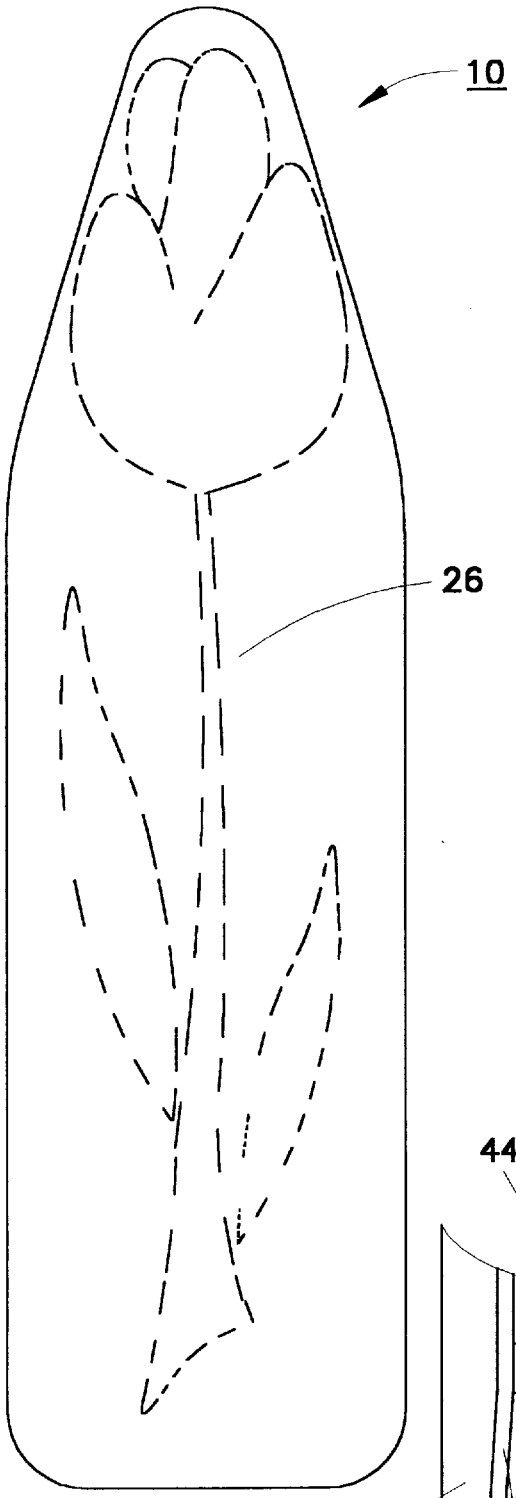
FIG. 2 is a top view of one embodiment of the ironing board cover of the present invention.

As shown in FIG. 2, the skirt is attached to top sheet 26. The top sheet 26 preferably is formed to be substantially the same size and shape as the top surface of a standard ironing board. As illustrated in FIG. 2, cover 10 preferably has some indicia or design for aesthetic or advertising purposes. Pad 28 preferably is also substantially the same size and shape as the top surface of a standard ironing board. Preferably, pad 28 is attached to the bottom surface of top sheet 26 about the periphery of the top sheet 26 by, for example but not limiting, sewing the pad 28 to the top sheet 26. Pad 28 preferably is made of material having proper cushioning and heat resistant characteristics. Preferred materials, such as synthetic felt or foam, are sufficiently supportive and preferably have a width of about ⅛ inch to about ¼ inch. The top sheet 26 and skirt 12 preferably are cotton, such as 60 square sheeting and may have a coating, such as Scotchgard®, a product of 3M Company of St. Paul, Minn., or other similar stain resistant coating.

The top sheet 26, skirt 12, and pad 28 combine to form an adjustable ironing board cover that may be installed on any standard ironing board and adjusted with the draw cord 22 to tighten the ironing board cover about the bottom of the ironing board. The top sheet 26 and pad 28 are attached to the skirt 12 about the outer periphery of the skirt 12. Thus, the component nose 12, sides 14, 16, and heel 18 portions each are attached to the top sheet 26 along the outer periphery and are formed with a hem 20 for draw cord 22 along the inner periphery.

Figure 3:
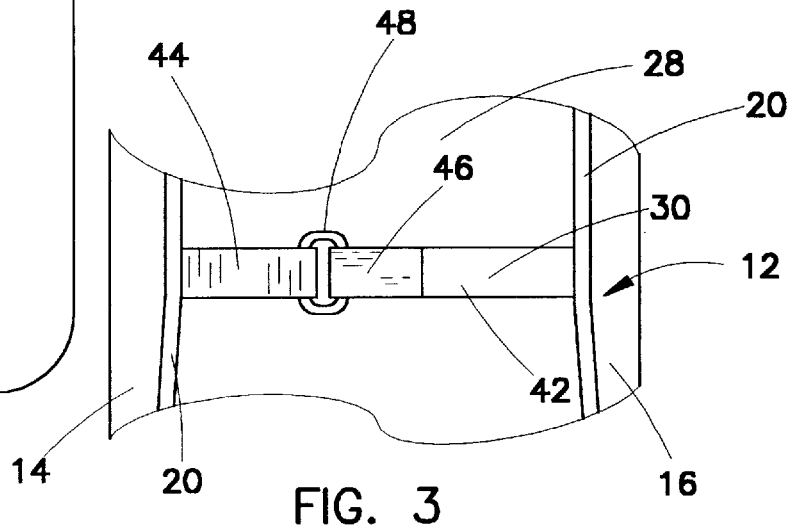
FIG. 3 is an exploded view illustrating one embodiment of a cinch of the present invention.
Figure 4:
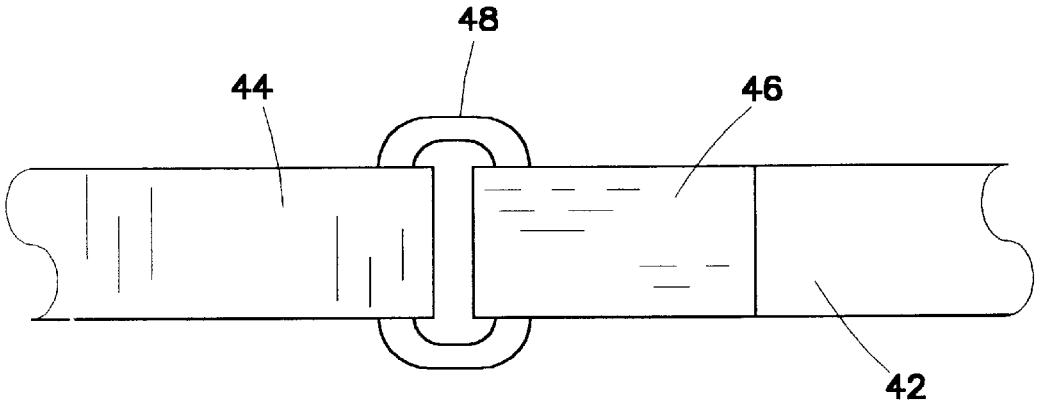
FIG. 4 is an exploded view illustrating the cinch of the present invention.
Figure 5:
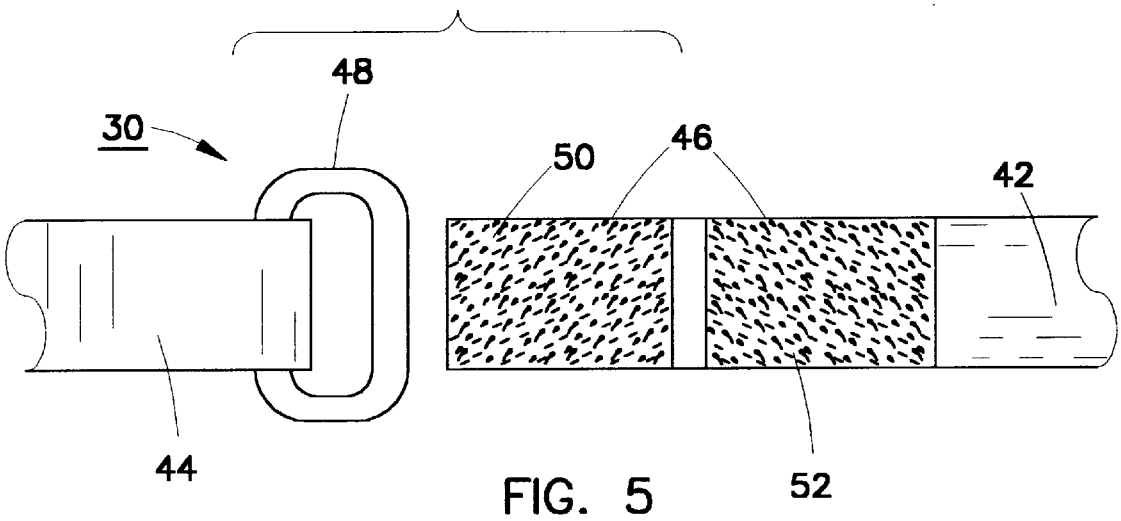
FIG. 5 is an exploded view illustrating the hook and loop fastener of the cinch of the present invention.

Additionally, it is preferred that ironing board cover 10 includes at least one cinch 30, as shown in FIGS. 1, 3 and 5. Each cinch 30 preferably is formed of elements 42, 44 preferably made of cotton webbing, rather than elastic material for durability and strength. Each element has two opposing ends. The first end of each member 42, 44 is respectively attached to the side portions 14, 16 of the skirt 12. The second end of the first element 42 includes hook and loop fastener 46, as known in the art. As shown in FIG. 5, hook and loop fasteners 46 (sometimes referred to as Velcro) are formed with an area of hook material 50 and an area of loop material 52 located on the same side of element 42 as the hook material but spaced apart from the hook material. As understood by those skilled in the art, areas 50, 52 may be interchanged, with the loop material 52 located distal to the side portion 16 rather than the hook material 50. The second end of second element 44 includes a ring 48. Preferably the ring is shaped to accommodate the width of the elements 42, 44. Ring 48 preferably is connected to second member 44 by threading a portion of the second end of second member 44 through ring 48 and securing the threaded portion to the remainder of the second member by any appropriate means, such as sewing. The first element 42 is formed appropriately such that the area of hook material 50 may be threaded through the ring 48 and connected to the area of loop material 52, or vice versa. Therefore the at least one cinch 30 allows the user to adjust and tighten the ironing board cover 10 after installation of the cover 10 onto the ironing board.

Although specific embodiments of the present invention have been illustrated and described in detail, it is to be expressly understood that the invention is not limited thereto. The above detailed description of the embodiment is provided for example only and should not be construed as constituting any limitation of the invention.

Modifications will be obvious to those skilled in the art, and all modifications that do not depart from the spirit of the invention are intended to be included within the scope of the appended claims.

We claim:

1. A cover for an ironing board comprising:

a top sheet having a top surface and a bottom surface and defining a periphery;

a pad of substantially the same size as the top sheet and attached to the bottom surface of the top sheet;

a skirt depending from the periphery of the top sheet and extending downwardly from the bottom surface;

said skirt comprising at least one nose portion and at least one heel portion, the skirt having a hem distal to the periphery of the top sheet;

an adjustable draw cord supported within the hem and exiting from the hem in the heel portion of the skirt; and at least one adjustable cinch connecting diametrically opposed hems.

2. The cover of claim 1 wherein the top sheet defines a forward arcuate edge, a rearward edge and two opposing side edges and wherein the at least one nose portion is attached to the forward edge of the top sheet;

at least two side portions are each attached to the top sheet mesially between the forward and rearward edges and also attached at a forward end to the nose portion and extending rearwardly from the nose portion;

the at least one heel portion is attached to the rearward edge of the top sheet and also attached at a forward end to the at least two side portions;

whereby the at least one nose portion, the at least two side portions, and the at least one heel portion are formed with a hem distal to the periphery of the top sheet to support the adjustable draw cord.

3. The cover of claim 1 wherein the at least one cinch further comprises:

a first element having a first and a second end wherein the first end is attached to one side portion of the skirt and the second end of the first element is formed with a hook and loop fastener; and a second element having a first and a second end wherein the first end is attached to the other side edge of said skirt at a corresponding and opposing point from the attachment of the first end of the first element, the second end of the second element including a ring such that the second end of the first element is threadedly engageable with the ring of the second end of the second element, whereby the at least one cinch is connected through the engagement of the hook and loop fastener to adjustably tighten the cover upon the ironing board.

4. The cover of claim 1 wherein the draw cord includes a spring-action-locking device.

5. The cover of claim 1 wherein the top sheet includes a design or indicia.

6. An ironing board cover having two side portions and an improved cinch comprising:

a first cinch element attached at one end to one side portion of the ironing board cover, the first element including at a second end, a hook and loop fastener; and a second cinch element attached at one end to the other side portion of the ironing board cover at a point diametrically opposing the first cinch element, the second cinch element including a ring at a second end such that the first cinch element is threadedly engageable with the ring of the second cinch element.

7. A cover for an ironing board comprising:

a top sheet having a top surface, a bottom surface, a forward edge, and a rearward edge;

a pad of substantially the same size as the top sheet attached to the bottom surface of the top sheet;

a skirt attached to the top sheet and extending downwardly from the bottom surface of the top sheet, the skirt comprising:

(a) at least one nose portion attached to the forward edge of the top sheet;

(b) at least two side portions each attached to the top sheet mesial between the forward and rearward edges and also attached at a forward end to the nose portion and extending rearwardly from the nose portion;

(c) at least one heel portion attached to the rearward edge of the top sheet and also attached at a forward end to the at least two side portions;

a hem formed along the free edge of the nose portion, the side portions and the heel portion of the skirt;

an adjustable draw cord supported within the hem, extending through the hem, and exiting through at least one opening in the heel portion; and at least one cinch, the at least one cinch including a first element and a second element, each element attached to an opposing hem of the at least two side portions, the second element having a ring and the first element having a hook and loop fastener that is threadedly engageable with the ring of the second element.

* * * * *